US008353216B2

(12) United States Patent
Giordano et al.

(10) Patent No.: US 8,353,216 B2
(45) Date of Patent: Jan. 15, 2013

(54) FAST-FIT FLUIDIC CONNECTING DEVICE FOR AN ELECTRIC HOUSEHOLD APPLIANCE PRESSURE SENSOR, AND RELATIVE PRESSURE SENSOR

(75) Inventors: Sergio Giordano, Caselle Torinese (IT); Domenico Pietrafesa, San Mauro Torinese (IT)

(73) Assignee: ITW Metalflex, Tolmin (SI)

( * ) Notice: Subject to any disclaimer, the term of this patent is extended or adjusted under 35 U.S.C. 154(b) by 105 days.

(21) Appl. No.: 12/996,458

(22) PCT Filed: Jun. 4, 2009

(86) PCT No.: PCT/IB2009/052376

§ 371 (c)(1),
(2), (4) Date: Dec. 6, 2010

(87) PCT Pub. No.: WO2009/147640

PCT Pub. Date: Dec. 10, 2009

(65) Prior Publication Data

US 2011/0072907 A1 Mar. 31, 2011

(30) Foreign Application Priority Data

Jun. 5, 2008 (IT) ..... TO2008A0435

(51) Int. Cl.
*G01L 7/00* (2006.01)

(52) U.S. Cl. ..... 73/756

(58) Field of Classification Search ..... None
See application file for complete search history.

(56) References Cited

U.S. PATENT DOCUMENTS

| | | | | |
|---|---|---|---|---|
| 5,107,706 | A * | 4/1992 | Tolf | 73/302 |
| 5,964,001 | A | 10/1999 | Johnson | |
| 2010/0154727 | A1* | 6/2010 | Malgorn et al. | 123/2 |
| 2010/0307236 | A1* | 12/2010 | Giordano | 73/299 |

FOREIGN PATENT DOCUMENTS

| | | | |
|---|---|---|---|
| EP | 0753281 | A1 | 1/1997 |
| EP | 0938864 | A1 | 9/1999 |
| EP | 2009408 | A2 | 12/2008 |
| GB | 2184749 | A * | 7/1987 |

OTHER PUBLICATIONS

ISR for PCT/IB2009/052376 mailed Sep. 11, 2009.

* cited by examiner

*Primary Examiner* — Andre Allen
(74) *Attorney, Agent, or Firm* — Lowe Hauptman Ham & Berner LLP

(57) ABSTRACT

A fast-fit device for fluidically connecting a pressure sensor to a water collecting tank of an electric household appliance including: a supporting body securable to a housing of the electric household appliance and carrying a first, blind tubular element, having a first open end, opposite to a second blind end; a second tubular element integrally obtained in one piece with a casing of the pressure sensor, which overhangingly extends therefrom for the entire length thereof and which displays external diameter and length smaller than the internal diameter and length of the first tubular element; a closing plug of the first end provided with a through hole which fluid-tightly receives in use the second tubular element; and first and second fastening means which are reciprocally complementary and integrally carried by the supporting body and the casing of the sensor, respectively.

11 Claims, 2 Drawing Sheets

FAST-FIT FLUIDIC CONNECTING DEVICE FOR AN ELECTRIC HOUSEHOLD APPLIANCE PRESSURE SENSOR, AND RELATIVE PRESSURE SENSOR

RELATED APPLICATIONS

The present application is national phase of International Application Number PCT/IB2009/052376 filed Jun. 4, 2009, and claims priority from, Italian Application Number TO2008A000435 filed Jun. 5, 2008.

TECHNICAL FIELD

The present invention relates to a protected, fast-fit fluidic device for connecting a pressure sensor to a water collecting tank of an electric household appliance, in particular a dishwater or washing machine.

BACKGROUND ART

It is known that in electric household appliances of the aforesaid type, the tank either underneath the washing chamber (in a dishwasher) or containing the basket (in a washing machine) is intended to collect a predetermined level of water, which is only exceeded in case of malfunctioning. At least one pressure sensor (pressure switch), hydraulically connected to the top of the tank or sump itself by means of a flexible pipe, is used to detect the level of water in the tank, within which tank or sump the pressure of the air trapped therein varies according to the level of water in the tank and, thus, according to the amount of liquid present in such a collecting volume.

If the volume of liquid exceeds the predetermined level, however, part of the liquid may flow up along the flexible connecting pipe and reach the sensor, thus damaging it.

Therefore, as a safety measure, the sensor is not directly connected to the flexible pipe, but through a protected, fluidic connecting device which defines a siphon air trap therein, which is interposed between a first joining union to the flexible pipe and the sensor itself, immediately upstream of the sensor.

In the known protected, fluidic connecting devices, the siphon air trap consists of a branch of a U-shaped pipe which connects the first union to a second union of the device, which is in use connected to an inlet nipple of the sensor. Such a solution is however relatively costly, large in size and unsuitable for a fast fitting, in particular of automatic type.

DISCLOSURE OF INVENTION

It is an object of the present invention to solve the described drawbacks by providing a fast-fit, fluidic connecting device of a sensor to a collecting volume of a fluid of which either the pressure or the level is intended to be measured, which is simple in structure, easy to be manufactured, reliable to be operated, small in size and low in cost.

The present invention thus relates to a device for providing a protected, fast-fit fluidic connection of a pressure sensor to a tank of an electric household appliance, such as a dishwasher or washing machine, as set forth in claim 1.

The invention further relates to an improved pressure sensor which may be used in such a device, as set forth in claim 11.

The device of the invention comprises a supporting body securable to a housing of the electric household appliance and carrying a first, blind tubular element, and a joining union for a hydraulic connecting pipe to the tank, laterally connected to the first tubular element; a closing plug of a first open end of the first tubular element, provided with a through hole; and first and second reciprocally complementary fastening means, which are integrally carried by the supporting body and a casing of the sensor, respectively.

The device of the invention further comprises a second tubular element, which, according to the main aspect of the invention, is integrally obtained in one piece with the casing of the pressure sensor and which overhangingly extends therefrom for the entire length thereof; furthermore, such a second tubular element displays smaller external diameter and length than the internal diameter and length of the first tubular element and the plug is adapted, in use, to thoroughly and fluid-tightly receive the second tubular element through its own hole.

In combination with the aforesaid structural features, the first and second fastening means display respective, reciprocal coupling directions by sliding, parallelly oriented to the first and second tubular elements, respectively, so as to determine in use, upon the coupling between the first and second fastening means, the insertion of the second tubular element into the first, coaxially to the same and through the plug, to form a siphon air trap defined by an annular gap delimited between the first and second tubular elements, immediately upstream of the sensor.

Thereby, there is obtained a simple, rapid and compact way of indirectly connecting the interior of the pressure sensor casing to the tank, i.e. with the interposition of a siphon air trap, so as to protect the internal measuring devices of the pressure sensor if the maximum liquid level allowed in the tank is exceeded.

Therefore, the invention further relates to an improved pressure sensor comprising a casing, an input nipple connectable in use to a water collecting tank of an electric household appliance and a pressure detecting device at the inlet nipple and accommodated inside the casing, wherein the inlet nipple is made as a straight tubular element integrally obtained in one piece with the casing and being longer than the maximum dimensions of the casing, externally delimited by a substantially smooth cylindrical wall which overhangly extends from the casing thus ending, on the side opposite to the casing itself, with an open free end; moreover, in combination with these features, on a first face, parallelly arranged to the tubular element, the casing is provided with means for fastening to a support, defined by straight guides oriented parallelly to the tubular element.

Thereby, with a simple modification of a part of the casing of the known pressure sensors only, an improved sensor is obtained, capable of being rapidly and automatically fitted on its support on the electric household appliance, with which it directly cooperates to form the needed device for a fluidic connection with the tank of the electric household appliance containing the fluid, the level of which is required to be measured. Furthermore, such a sensor has a lower production cost than that of the known sensors, because the smooth tubular element which replaces the traditional pressure inlet nipple is simpler to be manufactured, while ensuring in use, by virtue of its through coupling with the plug, which is preferably made of an elastomeric material, an excellent air sealing function, either equal to or better than that which may be obtained with the traditional nipple, on which a tube or union should be fitted in use, usually with a laborious operation and which thus implies relatively long fitting times.

BRIEF DESCRIPTION OF THE DRAWINGS

Further features and advantages of the present invention will be apparent from the following description of a non-limitative embodiment thereof, with reference to the figures of the accompanying drawings, in which.

BEST MODE FOR CARRYING OUT THE INVENTION

Figure 1:
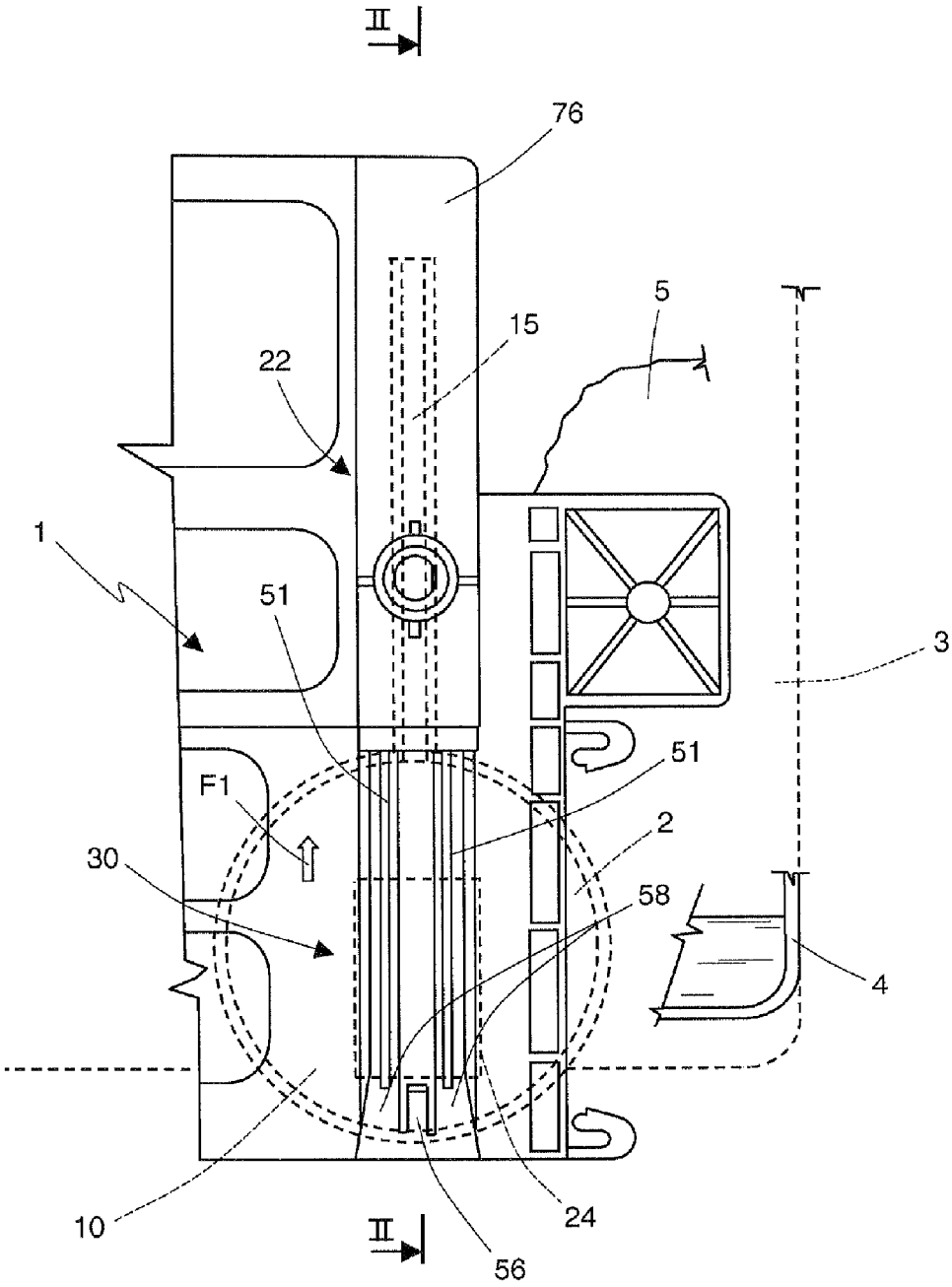
FIG. 1 is a front elevation view, with parts removed for greater clarity, of a connecting device according to the invention.
Figure 2:
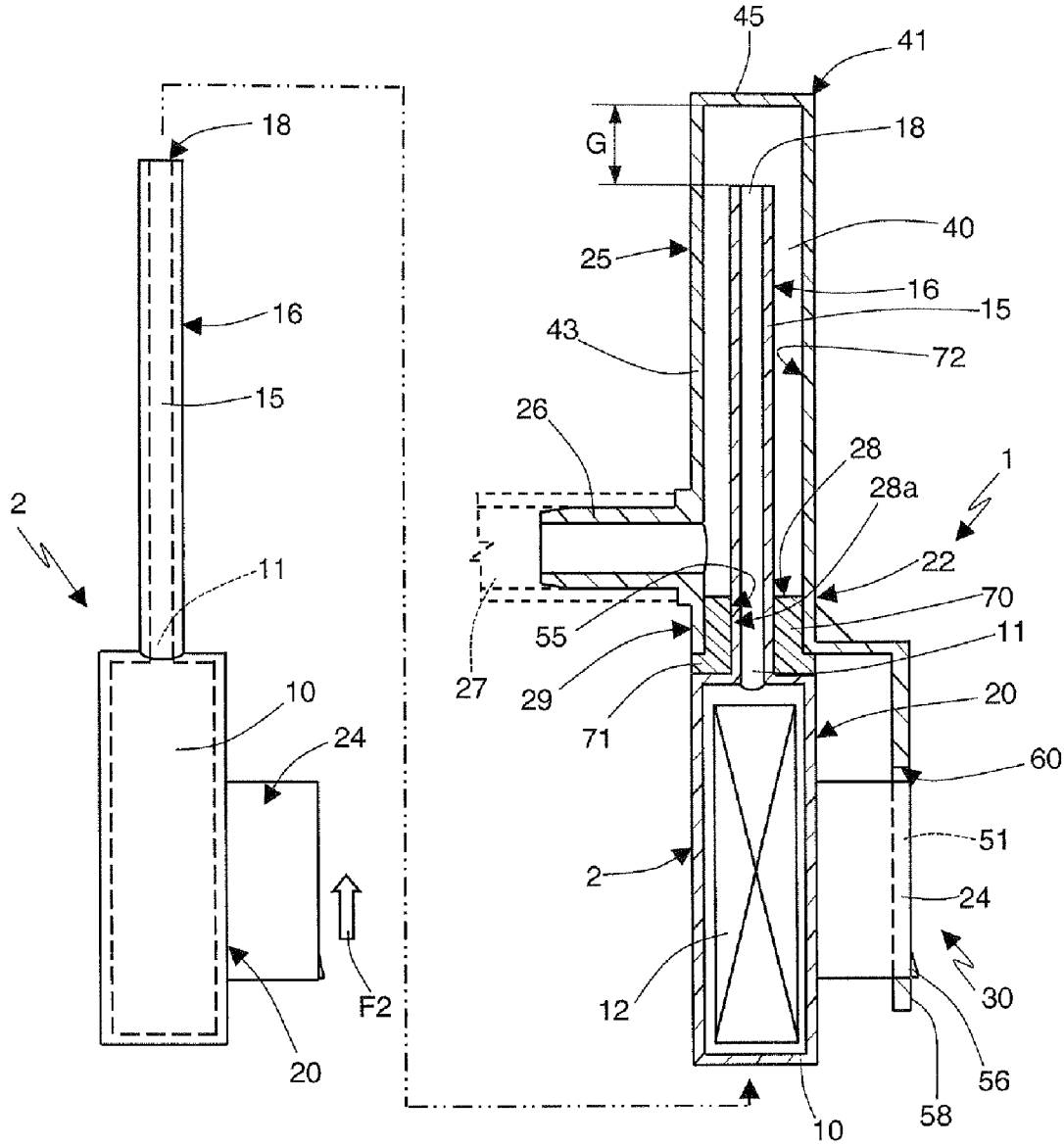
FIG. 2 shows a partially sectioned view according to a plotting plane II-II of the device in FIG. 1 and an improved sensor which may be associated thereto, shown before and after fitting.

With reference to FIGS. 1 and 2, numeral 1 indicates as a whole a device for making a protected fluidic connection of a sensor 2 (FIG. 2), in particular of a pressure sensor for an electric household appliance 3, such as a dishwasher or washing machine, only diagrammatically indicated with a dashed line, towards a water collecting tank 4 (or other working fluid of the electric household appliance 3) accommodated within a housing 5 of the electric household appliance 3 (FIG. 1).

According to a first aspect of the invention, the pressure sensor 2 is not a traditional sensor, but instead has novel aspects. In particular, it comprises a casing 10, an input nipple 11 connectable in use, as we will see, to a water collecting tank 4 of the electric household appliance 3, and a known device 12 for detecting the pressure at the inlet nipple 11, accommodated inside the casing 10 and only diagrammatically shown as a block.

According to a first aspect of the invention, the inlet nipple 11 is made as a straight tubular element 15 integrally obtained in one piece with the casing 10 and being longer than the maximum dimensions of the casing 10 itself, thus much longer (by one or more magnitude orders) than the length of a normal corrugated pressure inlet nipple. Furthermore, contrary to the known nipples, the tubular element 15 is externally delimited by a substantially smooth cylindrical wall 16; the tubular element 15, by means of its smooth wall 16, overhangly extends from the casing 10 (overhangingly in the radial direction, in the case shown of the casing 10 having a flattened circular shape), thus ending, on the side opposite to the casing 10, with an open free end 18.

Furthermore, in combination with the description above, on a first face 20 intended in use to face a supporting body 22 for joining the sensor 2 to the housing 5 of the electric household appliance 3 and parallelly arranged to the longitudinal symmetry axis of the tubular element 15, the casing 10 is provided with means 24 for fastening the support 22, defined by straight guides parallelly oriented to the tubular element 15 and to the axis thereof.

Therefore, according to the invention, the device 1 comprises: the supporting body 22, which is securable in use to the housing 5 of the electric household appliance 3 in a known manner; a first blind tubular element 25; a joining union 26 to a pipe 27 (known) for hydraulically connecting it to the tank 4, laterally connected to the tubular element 25; a closing plug 28 of a first open end 29 of the tubular element 25, which plug 28 is provided with a through hole 28*a*; and first and second reciprocally complementary fastening means, indicated by references 30 and 24, respectively, of which means 30 are integrally carried by the supporting body 22, and means 24 by the casing 10 of the sensor 2, respectively.

As previously mentioned, the latter is provided with the tubular element 15 integrally obtained in one piece with the casing 10 and which is an integral part of the device 1, because it is made not only as an element which overhangingly extends from the casing 10 over the entire length thereof, but especially as a tubular element displaying external diameter and length smaller than the internal diameter and length of the blind tubular element 25.

In particular, the plug 28 is made so as to be adapted, in use, to thoroughly and fluid-tightly receive the tubular element 15 through its through hole 28*a*; and the fastening means 30 and 24 display respective reciprocal coupling directions by sliding, indicated by the arrows F1 and F2 in FIGS. 1 and 2, respectively, parallelly oriented to the tubular element 25 and to the tubular element 15 (i.e. to the respective longitudinal symmetry axes thereof), respectively, and such to determine in use, upon the coupling between the fastening means 30 and 24, the insertion of the tubular element 15 into the tubular element 25, coaxially to the same, and through the plug 28, to form a siphon air trap 40 defined by an annular gap delimited between the tubular elements 15 and 25, immediately upstream of the sensor 2.

The blind tubular element 25 is cup-shaped and integrally, laterally and throughly carries in one piece the union 26 close to the first open end 29 thereof, which is opposite to a second, blind end 41 thereof.

In order to ensure the correct operation of the device 1, the supporting body 22 is obviously shaped so that the tubular elements 15 and 25 are arranged, in use, with the respective symmetry axes thereof being essentially vertical.

In the preferred non-limitative embodiment shown, the union 26 is integrally obtained in one piece with a cylindrical side wall 43 of the tubular element 25, from which it overhangly and radially extends outwards. Furthermore, the tubular element 15 is open at its first free end 18 facing the opposite side of the casing 10 and which is intended, in use, to remain facing and apart from a bottom wall 45 of the tubular element 25, delimiting the blind end 41 thereof.

The fastening means 30 comprise first straight guides 51 integrally carried by the supporting body 22 at the free end 29 of the tubular element 25 and axially overhanging therefrom, parallelly to the tubular element 25 itself and flush aligned with a mouth 55 of the open end 29, on the side opposite to the union 26.

The fastening means 30 further comprise snapping stop means 56 (in this illustrated case, a elastic tooth parallelly oriented to the guides 51) carried by a first end 58 of the guides 51, oriented towards the opposite side of the mouth 55 of the open end 29 of the tubular element 25.

The snapping stop means 56 are adapted to elastically cooperate with the fastening means 24, indeed consisting of the straight guides 24 which are integral with the casing 10, and which in use may be slidingly coupled in a side abutment with the guides 51, thus allowing in use the perfect alignment of the tubular element 15, to which they are parallel, with the tubular element 25; in particular, the face 20 on which the guides 24 are integrally obtained is the rear face 20 of the casing 10, indeed facing in use the supporting body 22, and in particular facing the overhanging guides 51.

The latter are further provided with axially abutting means 60 for the guides 24 such as to determine a predetermined axial positioning of the tubular element 15 with respect to the tubular element 25 which determines the presence of a clearance G between the end 18 and the bottom wall 45, which clearance G determines a useful fluidic passage section between the interior of the tubular element 25 and the interior of the tubular element 15 equal to or larger than the annular passage section defined by the annular gap 40.

The closing plug 28 is made of elastomeric material and has a first part or cylindrical length 70 adapted to fluid-tightly couple, in use, with an internal side surface 72 of a side wall 43 of the tubular element 25; the plug 28 further has a second part or cylindrical length 71, having a diameter larger than the part 70, adapted to rest in axial abutment, in use, against a peripheral edge of the open end 29 of the tubular element 25.

In the preferred example shown, the tubular element 25 is obtained in one piece such as an integral part of an upright 76 of a supporting and joining frame for the sensor 2 defining the supporting body 22, illustrated with the left part missing, for simplicity, which is generally symmetrically H-shaped and may thus include a second upright 76 (not shown) integrally provided with another tubular element 25 so that the same supporting body 22 may accommodate and support two sensors 2 at the same time, arranged side by side.

The invention claimed is:

1. A device for connecting a pressure sensor to a water collecting tank of an electric household appliance having a housing, said device comprising:

a supporting body securable to said housing and having a first tubular element with a closed distal end and an open proximal end, and a joining member extending laterally from said tubular element for connecting a pipe to the water collecting tank;

a closing plug disposed at said open proximal end of the first tubular element;

a casing for said pressure sensor attached to said first tubular element;

first and second reciprocally complementary fastening elements integral with said supporting body and said casing of the sensor, respectively;

wherein said supporting body further comprises a second tubular element integral with said casing of the pressure sensor and extending within said first tubular element and extending substantially the length said first tubular element, said second tubular element having an external diameter smaller than the internal diameter of said first tubular element;

said closing plug being adapted, in use, to throughly and fluid-tightly receive said second tubular element through said hole thereof; and said first and second fastening elements displaying corresponding reciprocal coupling directions in a slidable and parallel oriented direction to the first and to the second tubular elements, respectively, wherein, upon coupling between the first and the second fastening element, the second tubular element is inserted coaxially into the first tubular element and through said closing plug, to form a siphon air trap defined by an annular gap delimited between the first and the second tubular elements immediately upstream of the sensor.

2. A device according to claim 1, wherein the first tubular element is cup-shaped and integrally, laterally and throughly carries in one piece said first joining member close to said first open proximal end thereof opposite said second distal end thereof.

3. A device according to claim 1, wherein said supporting body is shaped so that said first and second tubular elements are arranged, in use, with respective symmetry axes thereof being essentially vertical.

4. A device according to claim 2, wherein said first joining member is integrally with and protrudes and radially extend outwardly from a cylindrical side wall of the first tubular element.

5. A device according to claim 2, wherein said second tubular element is open at a free end thereof facing the opposite side of the casing of the pressure sensor and is designed to remain, in use, facing to and shifted from a bottom wall of the first tubular element, delimiting said second, blind end of the same.

6. A device according to claim 1, wherein said first fastening element further comprises first straight guides integrally carried by the supporting body at the first free end of the first tubular element and axially protruding therefrom and parallel to the first tubular element and flush aligned with a mouth of the first open end of the same, from the side opposite to said first joining member; and snapping stop element by a first end of said first guides, which is orientated towards the opposite side of the mouth of the first open end of the first tubular element; said snapping stop element being adapted to elastically cooperate with said second fastening element.

7. A device according to claim 6, wherein said second fastening element includes second straight guides couplable in side abutment and slidingly with the first guides, and disposed axially parallel to said second tubular element, which guides are obtained on a rear face of said casing of the pressure sensor facing in use said supporting body.

8. A device according to claim 7, wherein said first guides are provided with axially abutting means for the second guides such as to determine a predetermined axial positioning of the second tubular element with respect to the first.

9. A device according to claim 1, wherein said closing plug is made of elastomeric material and presents a first cylindrical length adapted to fluid-tightly couple, in use, with an internal side surface of a side wall of the first tubular element; and a second cylindrical length, having a larger diameter, adapted to abutting rest in use against a peripheral edge of the open end of the first tubular element.

10. A device according to claim 1, wherein said first tubular element is obtained in one piece as an integral part of an upright of a supporting and joining frame for said sensor defining said supporting body.

11. A pressure sensor, including a casing, an input nipple connectable in use to a water collecting tank of an electric household appliance and a pressure detecting device inside the inlet nipple and disposed inside said casing; wherein said inlet nipple is a straight tubular element integrally formed in one piece with the casing and is longer than the maximum dimensions of the casing, externally delimited by a substantially smooth cylindrical wall protruding and extending from the casing and having ends on the side opposite to the casing itself, and an open free end; said casing further comprises fastening elements on a first face thereof and parallel to said tubular element to a support defined by straight guides oriented in parallel to said tubular element.

* * * * *